US007959256B2

(12) United States Patent
Huang et al.

(10) Patent No.: US 7,959,256 B2
(45) Date of Patent: Jun. 14, 2011

(54) DEVICE FOR CLEANING OUT RESIDUAL INK

(75) Inventors: Ying-Chieh Huang, Taipei (TW); Jung-Tai Chiang, Taipei (TW)

(73) Assignee: Kinpo Electronics, Inc., Taipei (TW)

( * ) Notice: Subject to any disclaimer, the term of this patent is extended or adjusted under 35 U.S.C. 154(b) by 128 days.

(21) Appl. No.: 12/385,634

(22) Filed: Apr. 15, 2009

(65) Prior Publication Data

US 2009/0284564 A1 Nov. 19, 2009

(30) Foreign Application Priority Data

May 13, 2008 (TW) ..... 97117620 A

(51) Int. Cl.
*B41J 2/165* (2006.01)

(52) U.S. Cl. ..... 347/33; 347/34

(58) Field of Classification Search ..... 347/20, 347/22, 29–40, 84–86
See application file for complete search history.

(56) References Cited

U.S. PATENT DOCUMENTS

| | | | | |
|---|---|---|---|---|
| 5,440,331 | A | 8/1995 | Grange | |
| 6,168,257 | B1 | 1/2001 | Aldrich | |
| 6,568,789 | B2 * | 5/2003 | Lin et al. | 347/33 |
| 6,637,856 | B2 | 10/2003 | Nishi et al. | |
| 7,311,390 | B2 | 12/2007 | Huang | |
| 2009/0184998 | A1 * | 7/2009 | Tamaki et al. | 347/33 |

* cited by examiner

*Primary Examiner* — Thinh H Nguyen
(74) *Attorney, Agent, or Firm* — Bacon & Thomas, PLLC

(57) ABSTRACT

A device for cleaning out residual ink. The device includes an assembly of a bed and a slide mount. The bed has an oblique rail. The slide mount is equipped with a wiping blade. The slide mount is drivable by an ink cartridge carrier to reciprocally move along the oblique rail on the bed. Accordingly, the wiping blade can move componentially along y-axis to wipe off residual ink remaining on a printhead of the ink cartridge.

12 Claims, 7 Drawing Sheets

DEVICE FOR CLEANING OUT RESIDUAL INK

BACKGROUND OF THE INVENTION

The present invention relates generally to a cleaning device, and more particularly to a cleaning device for cleaning out residual ink. The cleaning device has simplified structure and is able to directly move in response to an ink cartridge carrier to wipe off residual ink remaining on an inkjet printhead.

A conventional inkjet printer includes an ink cartridge with an inkjet printhead. The ink cartridge is disposed on an ink cartridge carrier and positioned above a paper-feeding path by a set height. The printhead is reciprocally movable in a direction normal to the paper-feeding path, whereby the printhead is able to jet ink onto a paper and print the paper with figures or characters.

In general, the printhead includes multiple jet nozzles for jetting ink onto the paper. In the inkjet operation, some ink drops often remain around the jet nozzles and eventually become solid depositions. The solid depositions will partially clog the jet nozzles to change the jet direction. This will affect the printing quality.

Various types of cleaning devices have been developed for solving the problem of residual ink remaining around the jet nozzles. These cleaning devices employ rotationally drivable brush hairs or wipers, which once or twice back and forth pass through a lower side of the jet nozzles to wipe off the residual ink remaining thereon. For example, U.S. Pat. Nos. 6,168,257 B1 and 5,440,331 disclose typical cleaning devices employing wipers for cleaning out the residual ink. The cleaning device generally includes a bed with different rails at different heights. A slide mount equipped with wiper units is movable along the rails, whereby the wiper units can wipe off the residual ink remaining on the jet nozzle of the printhead.

U.S. Pat. No. 6,637,856 B2 discloses a cleaning device including a rotatable cleaning roller arranged at a lower end of the jet nozzle for wiping off ink drops or solid ink remaining around the jet nozzle.

In another type of conventional cleaning device, several frames and slide mounts are arranged in the printhead maintenance station of an office machine. The frames and slide mounts are movable in different directions to make the wiper unit move in a set direction for wiping off the residual ink remaining on the printhead. For example, U.S. Pat. No. 7,311,390 B2 discloses a typical cleaning device including a frame and a slide mount disposed on the frame. A first base seat and a second base seat are arranged on the slide mount. The second base seat is equipped with a wiper set and a fixing seat. A first rail is longitudinally disposed on the slide mount, whereby the first and second base seats are freely movable within and along the first rail. A second rail, an oblique third rail and a fourth rail are disposed on the frame. The third rail and the first rail contain an angle. When an ink cartridge carrier moves toward the frame into contact with the fixing seat, the first and second base seats are pushed to move along the first rail of the slide mount and the second rail of the frame.

According to the above arrangement, the conventional cleaning device requires that:

1. The slide mount is movable along the third and fourth rails of the frame.
2. The wiper set, the fixing seat and the first and second base seats are simultaneously movable along the first rail of the slide mount and the second rail of the frame, whereby the wiper unit can wipe off the residual ink remaining on the inkjet printhead.

Such conventional cleaning device has some defects, which need to be improved. For example, such conventional cleaning device has complicated structure, operation pattern and connection relationship. As aforesaid, the first, second, third and fourth rails must cooperate with each other in operation. Moreover, the frame, the slide mount, the fixing seat and the first and second base seats must be adapted to each other to move the wiper set in the set direction to the inkjet printhead for wiping off the residual ink. Furthermore, it is troublesome to assemble these components.

It is therefore tried by the applicant to provide a cleaning device, which is able to directly move in response to an ink cartridge carrier to wipe off residual ink remaining on an inkjet printhead without any additional transmission mechanism (such as motor). Accordingly, the components of the cleaning device can be more easily assembled.

SUMMARY OF THE INVENTION

It is therefore a primary object of the present invention to provide an improved device for cleaning out residual ink. The device has simplified structure and can be more easily operated. The device includes an assembly of a bed and a slide mount. The bed has an oblique rail. The slide mount is equipped with a wiping blade. The slide mount is drivable by an ink cartridge carrier to reciprocally move along the oblique rail on the bed. Accordingly, the wiping blade can move componentially along y-axis to wipe off residual ink remaining on a printhead of the ink cartridge.

In the above device for cleaning out the residual ink, the slide mount is directly obliquely move along the oblique rail of the bed in response to the ink cartridge carrier. Therefore, the wiping blade of the device can be easily driven by the ink cartridge carrier to move in a set direction without using any complicated controlling mechanism.

In the above device for cleaning out the residual ink, the slide mount has a raised rail inclined by the same angle as the oblique rail of the bed. Accordingly, the raised rail can be held in the oblique rail of the bed. When the slide mount is driven by the ink cartridge carrier to move along a transverse reference x-axis, the wiping blade componentially moved along a longitudinal reference y-axis to wipe off the residual ink.

Alternatively, the slide mount has a recessed rail inclined by the same angle as the oblique rail of the bed. Accordingly, the oblique rail of the bed can be held in the recessed rail. When the slide mount is driven by the ink cartridge carrier to move along a transverse reference x-axis, the wiping blade componentially moved along a longitudinal reference y-axis to wipe off the residual ink.

The present invention can be best understood through the following description and accompanying drawings wherein:

DETAILED DESCRIPTION OF THE PREFERRED EMBODIMENTS

Figure 1:
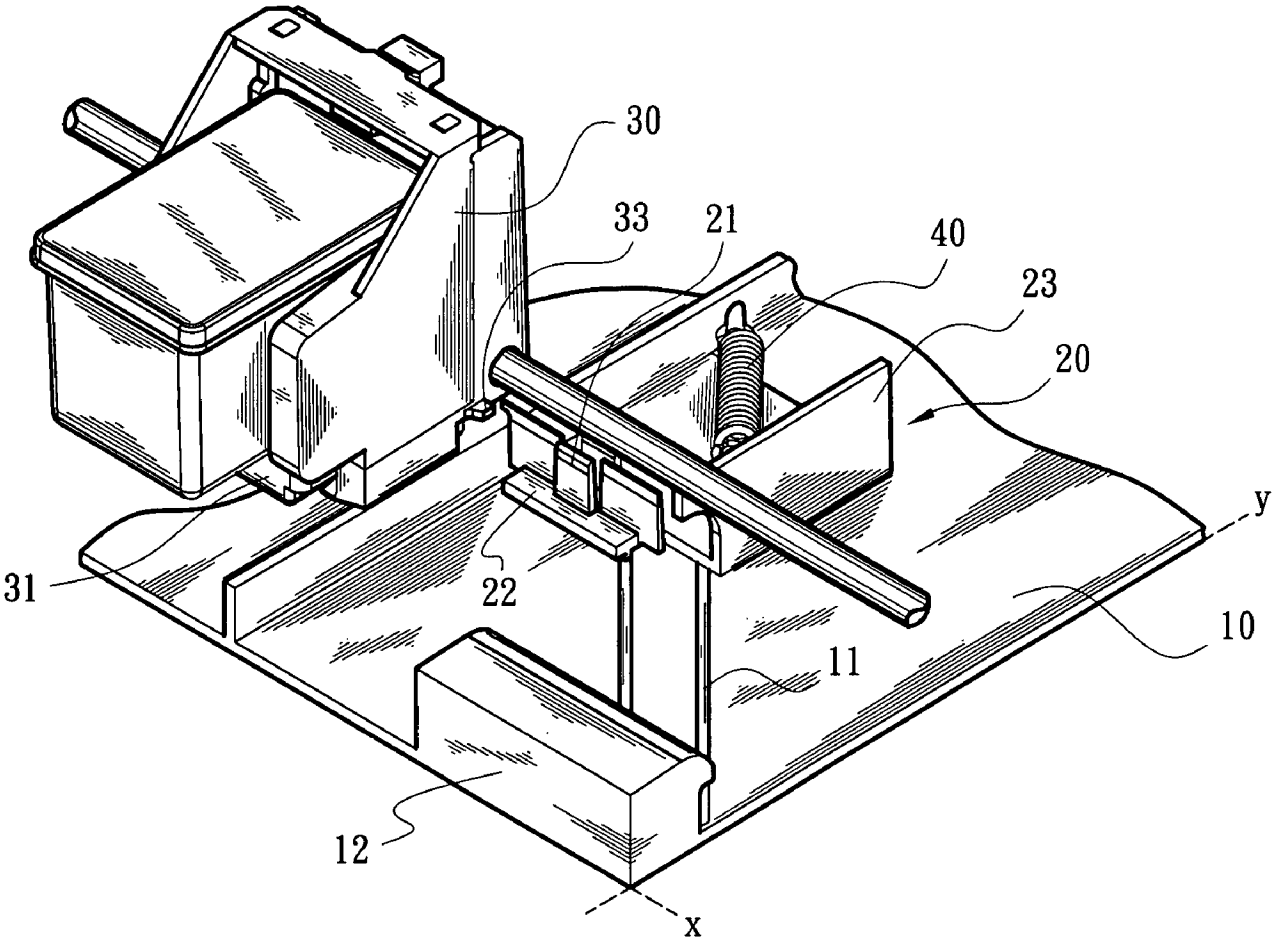
FIG. 1 is a perspective assembled view of the present invention, showing the position relationship between the bed, the slide mount and the ink cartridge carrier.
Figure 2:
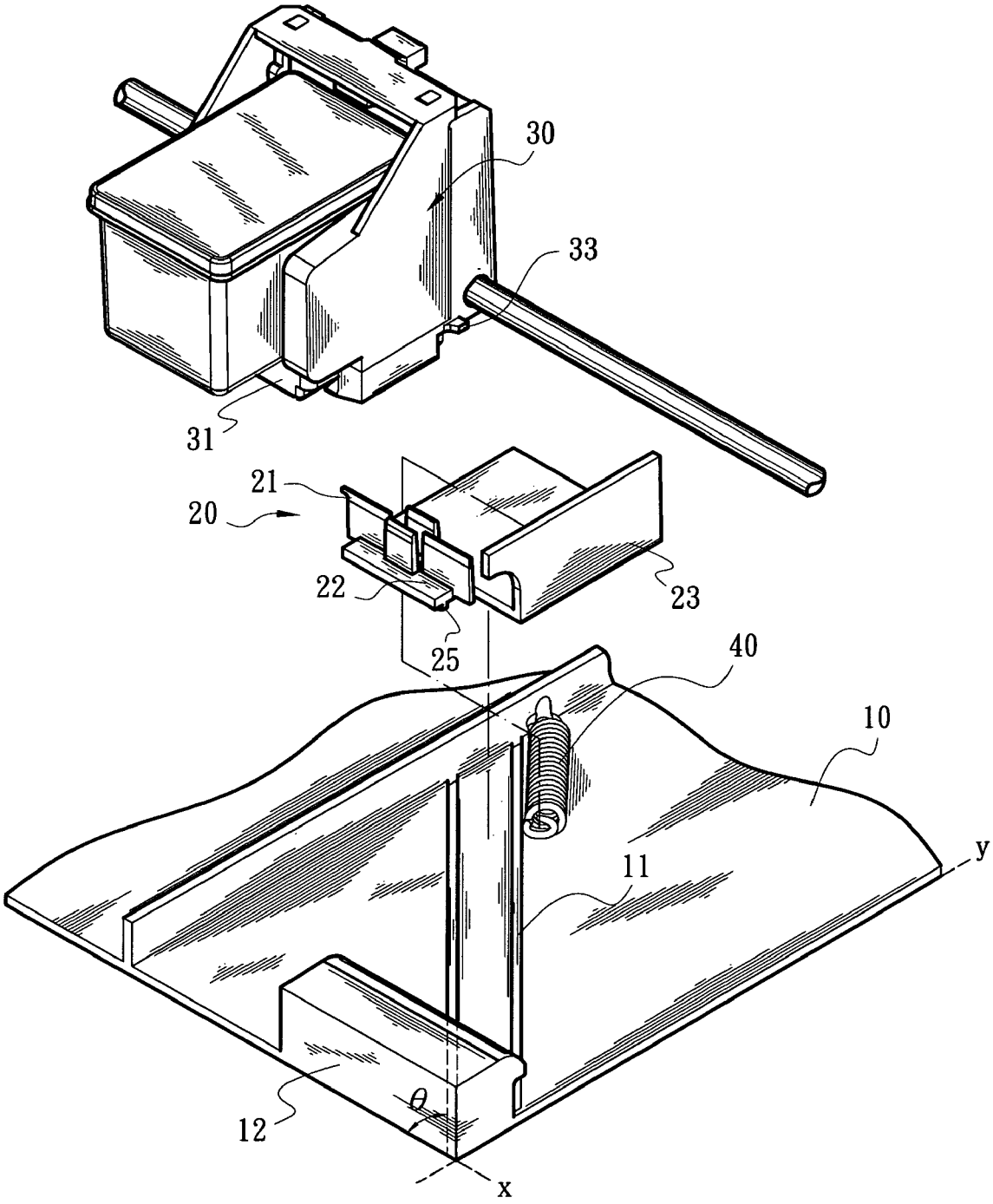
FIG. 2 is a perspective exploded view of the present invention according to FIG. 1 as seen in a direction.
Figure 3:
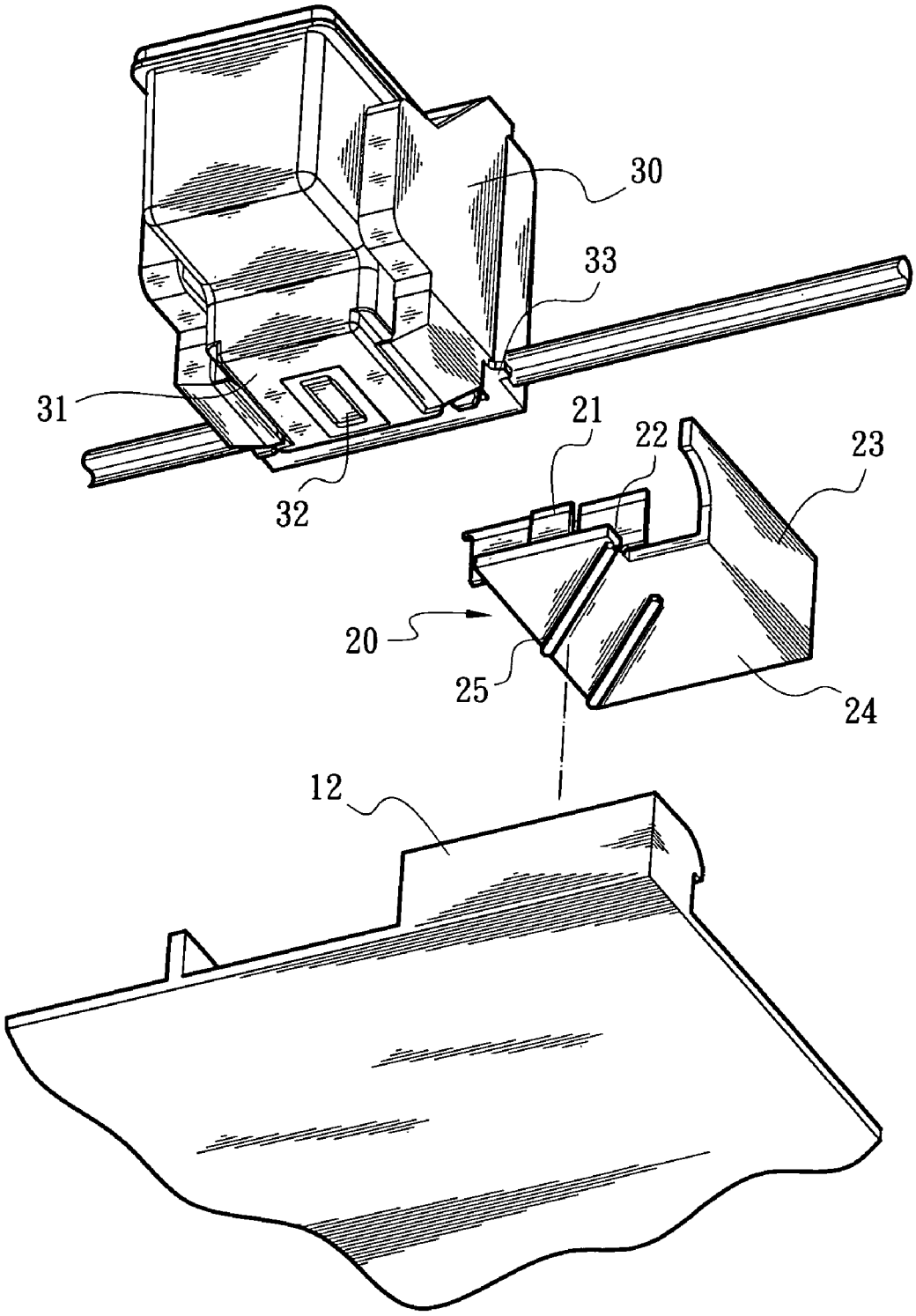
FIG. 3 is a perspective exploded view of the present invention according to FIG. 1 as seen in another direction.

Please refer to FIGS. 1, 2 and 3. The device of the present invention includes an assembly of a bed 10 and a slide mount 20. According to a preferred embodiment, the assembly is referred to as an inkjet printhead maintenance station. The bed 10 is defined with a transverse reference x-axis and a longitudinal reference y-axis. The bed 10 has an oblique rail 11. The oblique rail 11 and the x-axis contain an angle θ. The angle θ is within about 30°~60°. Preferably, the angle θ is 45°. The oblique rail 11 can be a raised rail or a recessed rail. In the embodiment of FIG. 2, the oblique rail 11 is a recessed rail.

The slide mount 20 is equipped with a wiping blade 21. As shown in FIGS. 1 and 2, the wiping blade 21 is positioned near a front end section 22 of the slide mount 20. The slide mount 20 has a vertical wall 23 in interference with an ink cartridge carrier 30. Accordingly, the ink cartridge carrier 30 can push and drive the slide mount 20. (This will be further described hereinafter.)

Referring to FIGS. 1 and 2, a resilient member 40 is mounted on the bed 10. Two ends of the resilient member 40 are respectively fixed on the bed 10 and the slide mount 20. When the slide mount 20 is released from the pushing force of the ink cartridge carrier 30, the resilient member 40 is able to pull the slide mount 20 back to its home position. Preferably, the bed 10 has a stopper section 12 for restricting movement of the slide mount 20 within a certain range.

As in the conventional device, the ink cartridge carrier 30 is reciprocally moved along the transverse reference x-axis. As shown in FIG. 3, the ink cartridge carrier 30 is provided with an inkjet printhead 31 having a jet nozzle 32. The ink cartridge carrier 30 has a side projection 33 in abutment with the wall 23 of the slide mount 20 for pushing the same.

FIG. 3 shows that a bottom 24 of the slide mount 20 has a load section 25, which is inclined by the same angle as the oblique rail 11 of the bed. Preferably, the load section 25 is a raised rail or a recessed rail. In the embodiment of FIG. 3, the load section 25 is a raised rail complementary to the oblique rail 11 of the bed 10. Accordingly, the load section 25 is held in the oblique rail 11, whereby the slide mount 20 can securely reciprocally move along the oblique rail 11 of the bed in response to the ink cartridge carrier 30. In other words, the slide mount 20 is directly obliquely displaceable along the oblique rail 11 of the bed 10.

Figure 4:
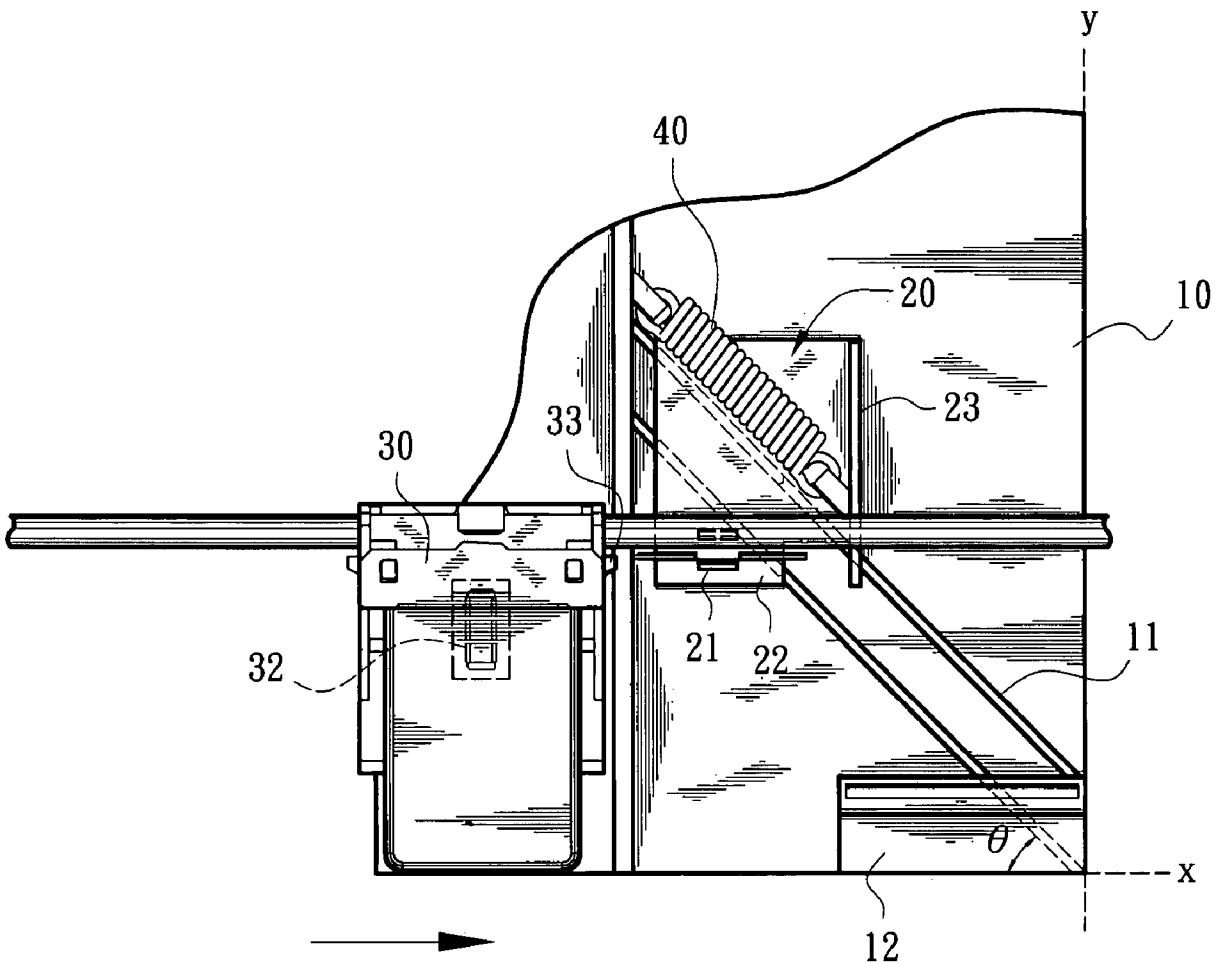
FIG. 4 is a top view of the present invention, showing the operation thereof.
Figure 5:
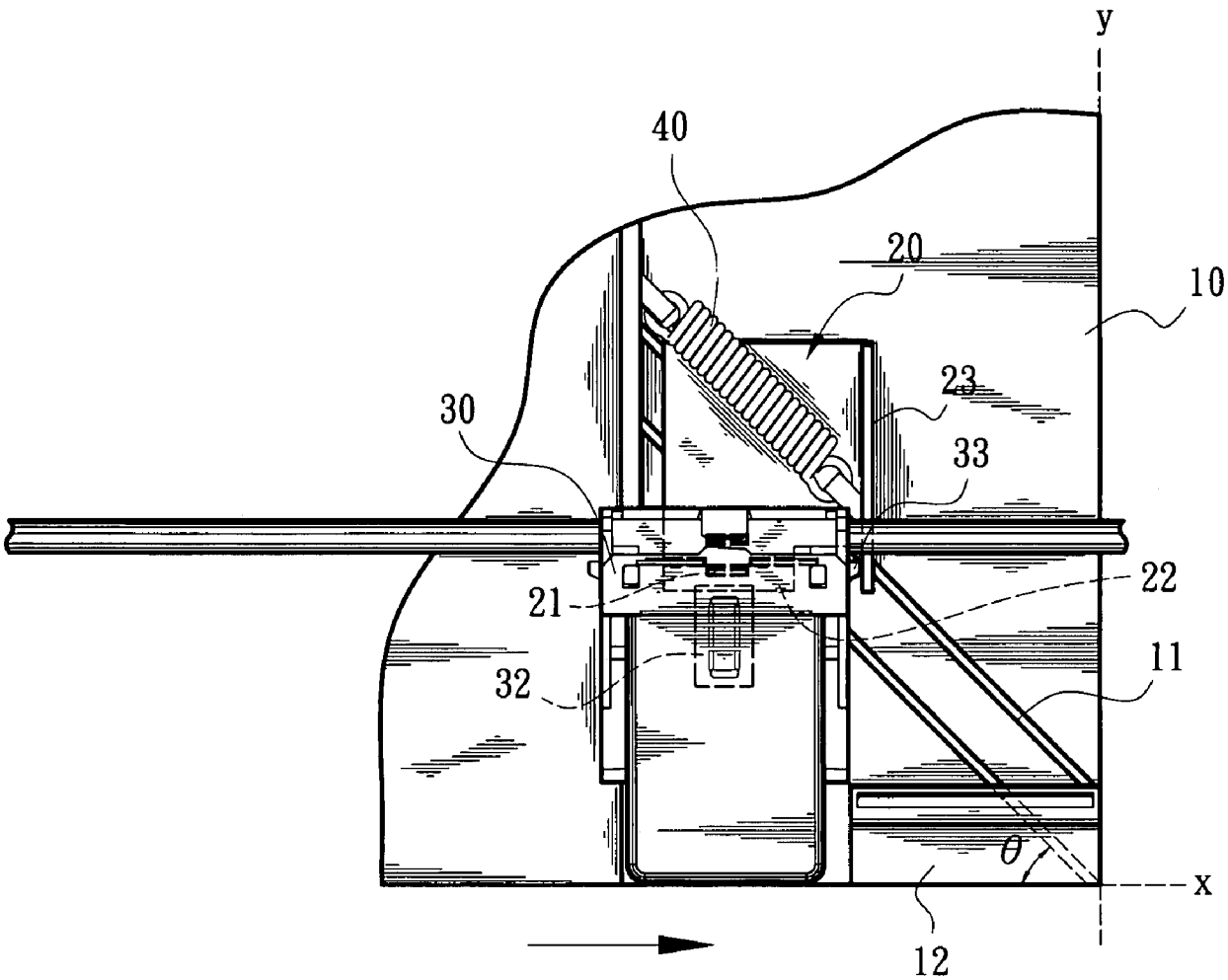
FIG. 5 is a top view of the present invention according to FIG. 4, showing that the ink cartridge carrier pushes the slide mount to componentially move along y-axis.
Figure 6:
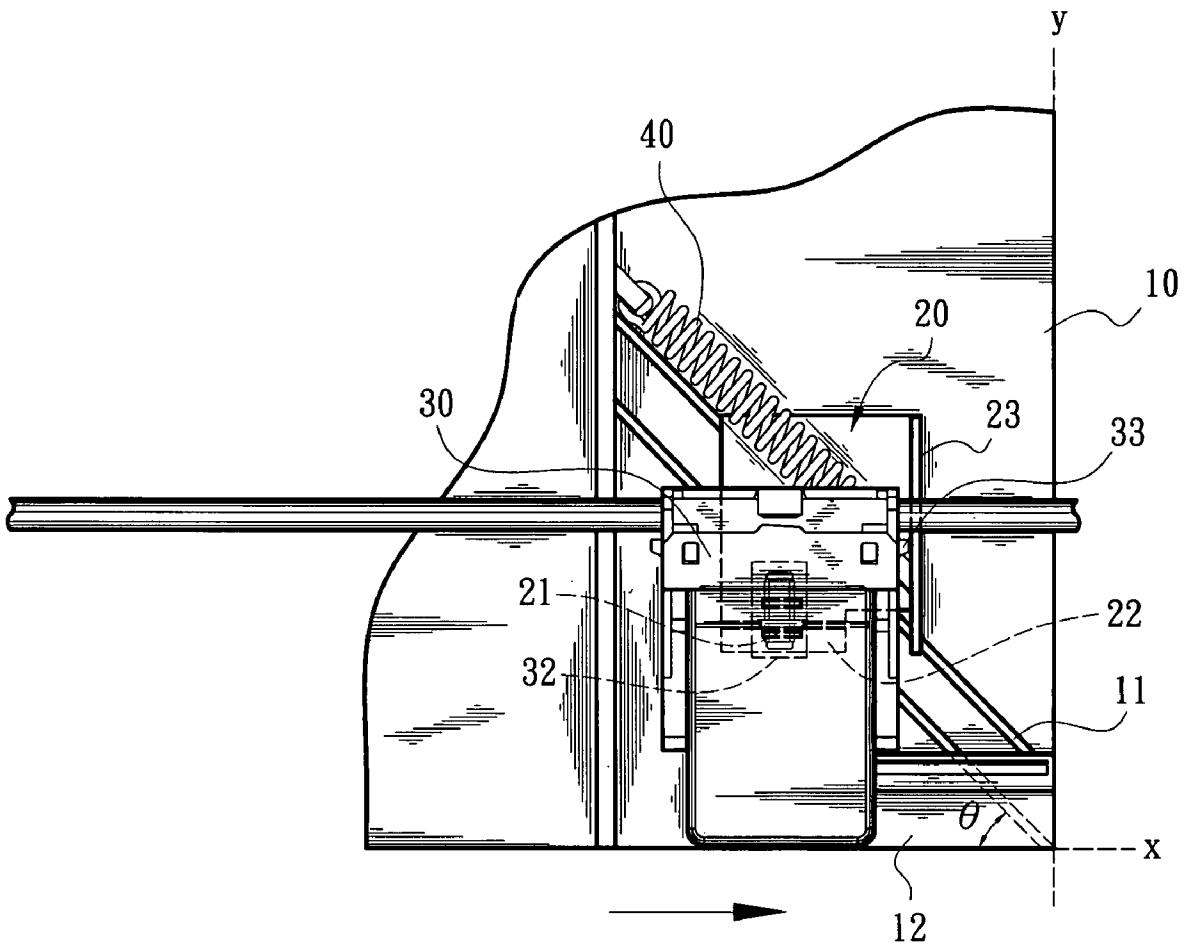
FIG. 6 is a top view of the present invention according to FIG. 5, in which the phantom line shows that the wiping blade wipes off the residual ink remaining on and around the jet nozzle.

Referring to FIGS. 4 and 5, when the ink cartridge carrier 30 with the inkjet printhead 31 moves rightward in a direction of the arrow (to the inkjet printhead maintenance station), the side projection 33 of the ink cartridge carrier 30 moves into contact with the wall 23 of the slide mount 20. At this time, the ink cartridge carrier 30 pushes the slide mount 20 to directly move along the oblique rail 11 of the bed 10. At this time, the wiping blade 21 moves componentially along the y-axis to wipe off residual ink remaining on and around the jet nozzle 32 as shown by phantom line of FIG. 6. It is also shown in FIG. 6 that when the slide mount 20 is driven by the ink cartridge carrier 30, the resilient member 40 is extended to conserve energy.

Figure 7:
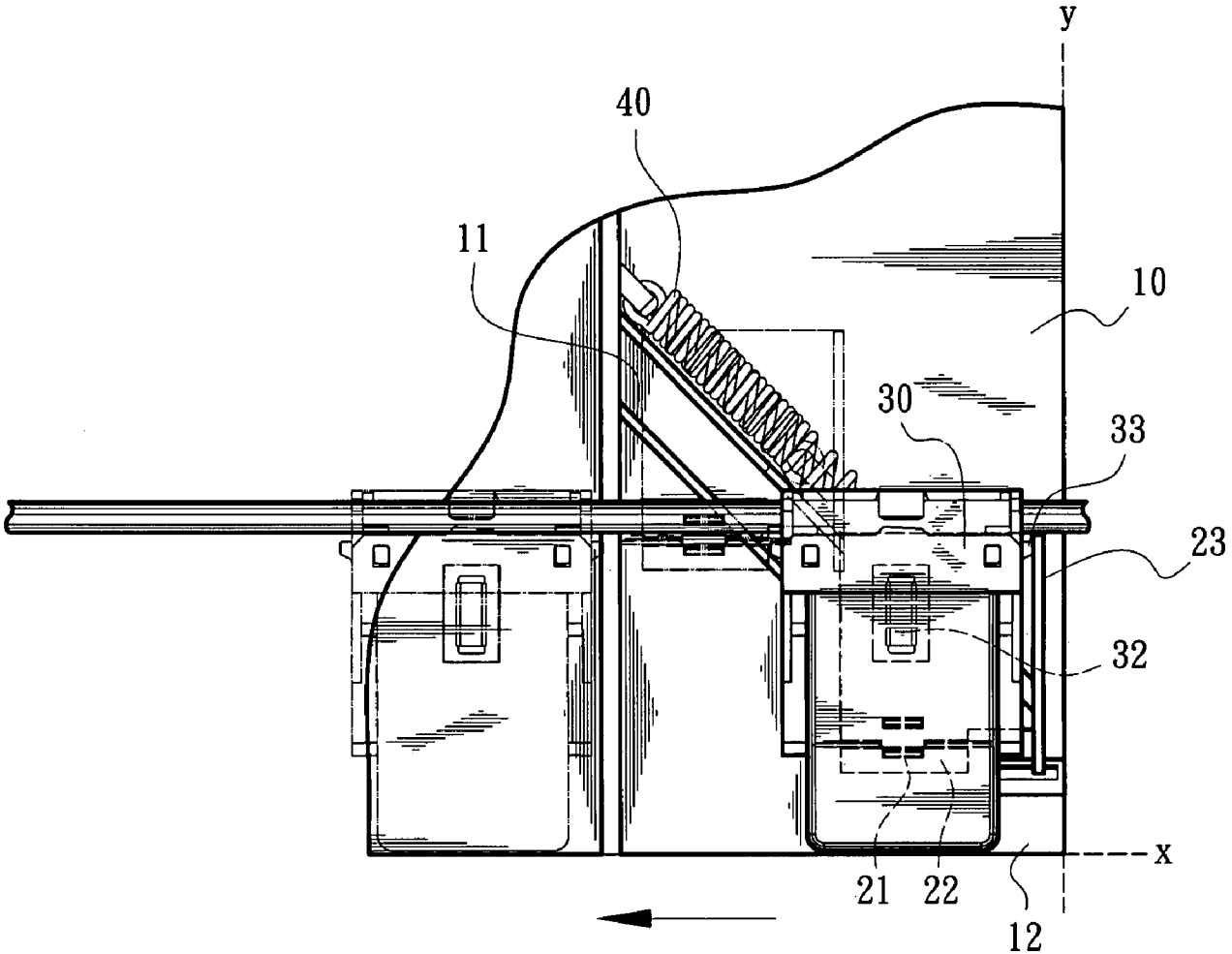
FIG. 7 is a top view of the present, invention according to FIG. 6, in which the solid line and phantom line show that after reaching the end of the inkjet printhead maintenance station, the ink cartridge carrier starts to move leftward.

As shown by the phantom line of FIG. 7, when the ink cartridge carrier 30 reaches the end of the inkjet printhead maintenance station, the wiping blade 21 totally passes over the jet nozzle 32 to complete the residual ink wiping work. Also, it is shown by the phantom line of FIG. 7 that when the ink cartridge carrier 30 moves leftward (in the direction of the arrow), the slide mount 20 is released from the pushing force, the resilient member 40 will release the previously conserved energy to pull the slide mount 20 back to its home position as shown in FIG. 4.

According to the above arrangement, the device for cleaning out residual ink of the present invention has the following advantages:

1. In the conventional cleaning device, the first, second, third and fourth rails must cooperate with each other in operation. Moreover, the frame, the slide mount, the fixing seat and the first and second base seats must be adapted to each other to move the wiper set in the set direction to the inkjet printhead for wiping off the residual ink. In contrast, the slide mount 20 of the present invention is directly movable along the oblique rail 11 of the bed. Accordingly, the wiping blade 21 can move componentially along the reference y-axis to wipe off residual ink remaining on and around the jet nozzle 32.
2. The conventional cleaning device has complicated structure, operation pattern and connection relationship. Furthermore, it is troublesome to assemble the components. In contrast, the components of the cleaning device of the present invention can be more easily assembled.

The above embodiments are only used to illustrate the present invention, not intended to limit the scope thereof. Many modifications of the above embodiments can be made without departing from the spirit of the present invention.

What is claimed is:

1. A device for cleaning out residual ink, comprising:

an assembly of a bed and a slide mount and a resilient member, the bed having an oblique rail, the slide mount being equipped with a wiping blade, the resilient member being mounted between the bed and the slide mount, the slide mount having a load section slidably assembled with the oblique rail, the slide mount with the wiping blade being movable along the oblique rail of the bed, whereby the wiping blade can move along a reference axis to wipe off residual ink remaining on an inkjet printhead, wherein the load section is disposed under a bottom of the slide mount, the load section being a rail inclined by the same angle as the oblique rail of the bed, whereby the load section can be held in the oblique rail of the bed.

2. The device for cleaning out residual ink as claimed in claim 1, wherein the bed is defined with a reference x-axis and a reference y-axis, the oblique rail and the reference x-axis containing an angle.

3. The device for cleaning out residual ink as claimed in claim 1, wherein the oblique rail is a recessed rail.

4. The device for cleaning out residual ink as claimed in claim 1, wherein the oblique rail is a raised rail.

5. The device for cleaning out residual ink as claimed in claim 1, wherein the slide mount has a front end section and the wiping blade is positioned at the front end section.

6. The device for cleaning out residual ink as claimed in claim 1, wherein the slide mount has a wall.

7. The device for cleaning out residual ink as claimed in claim 1, wherein the resilient member has two ends, which are respectively fixed on the bed and the slide mount.

8. The device for cleaning out residual ink as claimed in claim 1, wherein the bed has a stopper section for restricting movement of the slide mount within a certain range.

9. The device for cleaning out residual ink as claimed in claim 1, wherein the slide mount is pushable and drivable by an ink cartridge carrier.

10. The device for cleaning out residual ink as claimed in claim 9, wherein the ink cartridge carrier has a side projection.

11. The device for cleaning out residual ink as claimed in claim 1, wherein the load section is a raised rail.

12. The device for cleaning out residual ink as claimed in claim 1, wherein the load is a recessed rail.

* * * * *